US005671488A

United States Patent [19]

Greferath

[11] Patent Number: 5,671,488

[45] Date of Patent: Sep. 30, 1997

[54] SHOWER PARTITION

[75] Inventor: Hans-Gerd Greferath, Bad Salzuflen, Germany

[73] Assignee: Temotrans B.V., Purmerend, Netherlands

[21] Appl. No.: 591,649

[22] PCT Filed: Jun. 14, 1995

[86] PCT No.: PCT/EP95/02315

§ 371 Date: Apr. 15, 1996

§ 102(e) Date: Apr. 15, 1996

[87] PCT Pub. No.: WO95/34237

PCT Pub. Date: Dec. 21, 1995

[30] Foreign Application Priority Data

Jun. 14, 1994 [DE] Germany ..... 44 20 711.5

[51] Int. Cl.[6] ..... A47K 3/22

[52] U.S. Cl. ..... 4/607; 4/610; 4/596

[58] Field of Search ..... 4/607, 596, 600, 4/609, 610, 612, 613, 614, 584, 605; 52/35, 39

[56] References Cited

U.S. PATENT DOCUMENTS

| | | | |
|---|---|---|---|
| 3,449,770 | 6/1969 | Casebolt | 4/607 |
| 3,745,594 | 7/1973 | Cosper | 4/612 |
| 4,879,858 | 11/1989 | Murdoch | 52/35 |
| 5,060,322 | 10/1991 | Delepine | 4/612 |
| 5,297,301 | 3/1994 | Sodrel | 4/609 |

FOREIGN PATENT DOCUMENTS

| | | | |
|---|---|---|---|
| 415058 | 3/1991 | European Pat. Off. | 4/612 |
| 7146787 | 12/1971 | Germany . | |
| 4576274 | 7/1976 | Germany . | |
| 7723456 | 11/1977 | Germany . | |
| 3326790 | 2/1984 | Germany . | |
| 3711152 | 4/1987 | Germany . | |
| 4031923 | 10/1990 | Germany . | |
| 421432 | 3/1967 | Switzerland . | |
| 2006002 | 5/1979 | United Kingdom . | |
| 2056519 | 3/1981 | United Kingdom . | |

*Primary Examiner*—David J. Walczak
*Attorney, Agent, or Firm*—Pretty, Schroeder & Poplawski

[57] ABSTRACT

A shower partition unit that separates the shower compartment formed by a shower tray from the rest of the room in a building. The partition is adjacent to an edge of a shower tray and extends upward from the floor of the room to a predetermined height. The partition may be sealed by means of a connection profile relative to the tray edge. A door partition may also extend from the floor of the room up to the tray edge. The door partition may be terminated on its upper end portion by the connection profile. The lower portion of the partition and the door partition may be provided with a decoration.

10 Claims, 9 Drawing Sheets

SHOWER PARTITION

DESCRIPTION

The present invention relates to a shower partition comprising at least one vertical partition unit which separates the shower compartment formed by a shower tray from the rest of the room in a building.

Very different designs of shower partitions are known from the prior art. A shower tray is normally installed in the corner of a room, so that the walls of the room already define two sides of the shower compartment. Consequently, the open sides must be shut off in a suitable manner, as is known from the prior art. This was previously done by means of a shower curtain, but solutions have become prevalent since then where a glass pane is mounted on the tray edge instead of a curtain. To be able to enter the tray, one of the glass walls is designed as a door.

The prior-art development of a shower partition with glass walls has the disadvantage that the shower partition must be installed on the tray edge. Since the tray edge should not be drilled or damaged, the shower partition is just attached, so that difficulties already arise with respect to installation and mounting. Another essential disadvantage is that the tray edge and a base of the tray remain visible. The base is normally provided with tiles, but may also be concealed in another manner. This requires extra work during construction of the shower and, especially when the shower is installed into an existing bath at a later time, it is very difficult to adapt the optical design of the base to the remaining room, for instance, to obtain identical or matching tiles.

It is the object of the present invention to provide a shower partition of the above-mentioned kind which is of a simple structure and can be produced easily at low costs and avoids the disadvantages of the prior art and which is especially independent of the structure and design of the tray and meets the highest optical demands.

This object is achieved according to the invention in that the partition is adjacent to the tray edge and extends upwards from the floor of the room to a predetermined height.

The shower partition of the invention has a number of considerable advantages. Since at least one partition (when several partitions are used, one of the partitions can include a door) extends upwards from the floor of the room to the desired height in accordance with the invention, the partition conceals the shower tray and the base area of the shower tray entirely. Furthermore, the tray edge cannot be seen from the outside of the shower partition. This has the advantage that no high demands must be made on design and structure of the base of the tray. As a rule, it is possible to freely erect the tray itself. This is normally done on adjustable support feet. Any facing or sealing of the tray in a wall is not necessary. This simplifies the installation of a tray quite considerably. This, in turn, saves costs to a considerable extent.

Since neither the tray nor the tray edge nor the base area are visible in the design according to the invention, the shower partition satisfies the highest optical demands. It is especially easy to install the shower partition in already existing bathrooms, etc. without difficulties arising with respect to the optical design of the tray base.

Another considerable advantage is that the partition can be directly mounted on the floor of the room. This leads to a solid construction which is per se stable, and it is here possible to install, in particular, very heavy partitions without any problems.

In accordance with the invention the partition can be installed on the floor of the room by simply mounting and sealing the lower edge of the partition. Sealing may be in the form of a silicone strip or by way of a silicone paste or a similar sealant. However, it is also possible to provide a mounting rail on the lower edge of the partition, the mounting rail being fixedly connectable to the floor of the room and additionally permitting compensation for uneven floors, inclined floors, or the like.

In an advantageous development of the invention, the partition is sealed by means of a connection profile relative to the tray edge. The connection profile may preferably be attached to a horizontal edge portion of the tray edge. In the last-mentioned variant, use is made of a shower tray which has a horizontally extending free edge. The connection profile may here be provided with a U-shaped cross-section which is directly attached onto the tray edge. The connection profile may surround the whole tray edge, thereby sealing the tray also relative to the walls of the room. This results in very advantageous optical effects; a stable border is additionally formed which, when the shower tray is being installed, can be adapted to the local conditions, for instance, so as to compensate for slightly inaccurate dimensions of the installation room.

In an alternative embodiment, the connection profile may also be designed as a pure sealing profile which is inserted into the transition portion between the tray edge and the separation wall. The sealing profile and the seal, respectively, may either be prefabricated or applied as a paste-like compound during installation. Hence, it is possible to use trays which have an angled or bent outer edge.

To permit installation of a door, it is possible according to the invention that a door partition extending from the floor of the room up to the edge portion of the tray edge is provided in the area of a door of the shower partition. This door partition can be mounted in the same manner as the above-described partition on the floor of the room and secured to the tray edge. The door partition is preferably also upwardly bordered by means of a connection profile, for instance, by the already described connection profile. The profile can grip over the door partition on the upper edge thereof so as to avoid any damaging of the door partition and to exclude any injuries of a person using the shower. In accordance with the invention, the door of the shower partition is provided with a lower sealing strip which in the closed state of the door grips over at least part of the connection profile, thereby diverting splash water into the shower compartment.

The partition and/or door partition are preferably mounted by means of a holding section which can be attached onto the partition or door partition and fastened to the wall of the room. The holding section can be provided with a facing to cover the mounting screws. Furthermore, the holding section can serve to support hinge elements of the door.

To be able to make the shower partition of the invention transparent or semitransparent in its upper portion in the desired manner and to conceal the base area and the area of the shower tray optically at the same time, it may be advantageous when the partition is provided with a decoration. The same is applicable to the door partition.

The door can be arranged as a revolving door or a swivelling door according to the invention; a sliding door is also possible as a rule.

The shower partition of the invention can be used in the most different types of shower trays, both in acryl trays and in steel trays. The installation or mounting means which are normally provided for the tray can here be used in unchanged form. It goes without saying that the invention is not restricted to shower trays or shower partitions; rather, other types of tray or tubs, for instance bathtubs, etc., may also be provided with the partition. This is especially applicable to large tubs that are partly embedded in the floor of a room.

Both the partition and the door partition preferably consist of single-pane safety glass.

The invention shall now be described with reference to an embodiment taken in conjunction with the drawing, in which:

FIG. 1 is a perspective view of a first embodiment of the shower partition of the invention;

FIG. 2 ms a partial sectional view of the tray and of the lower portion of the partition;

Figure 1:
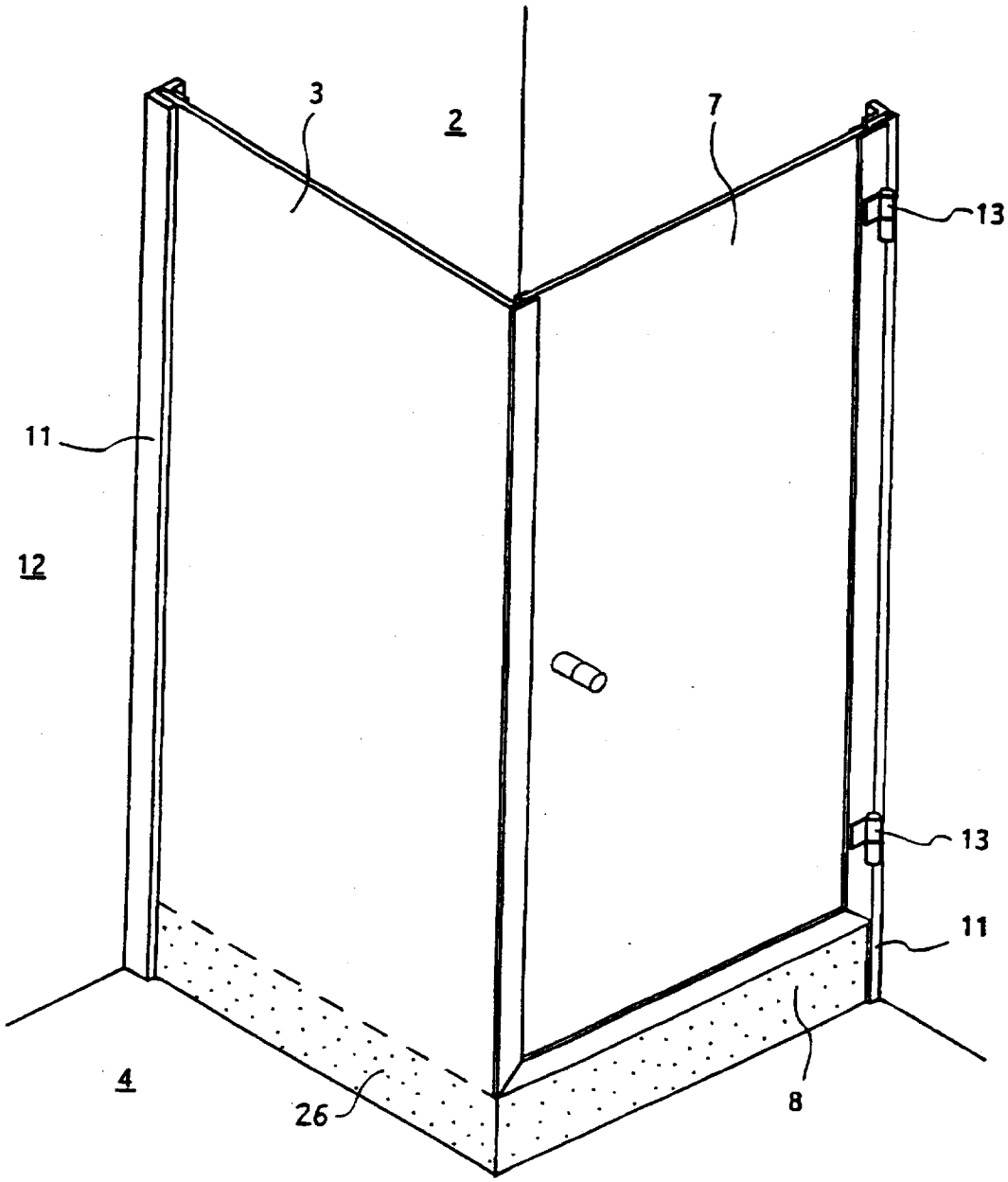
Figure 2:
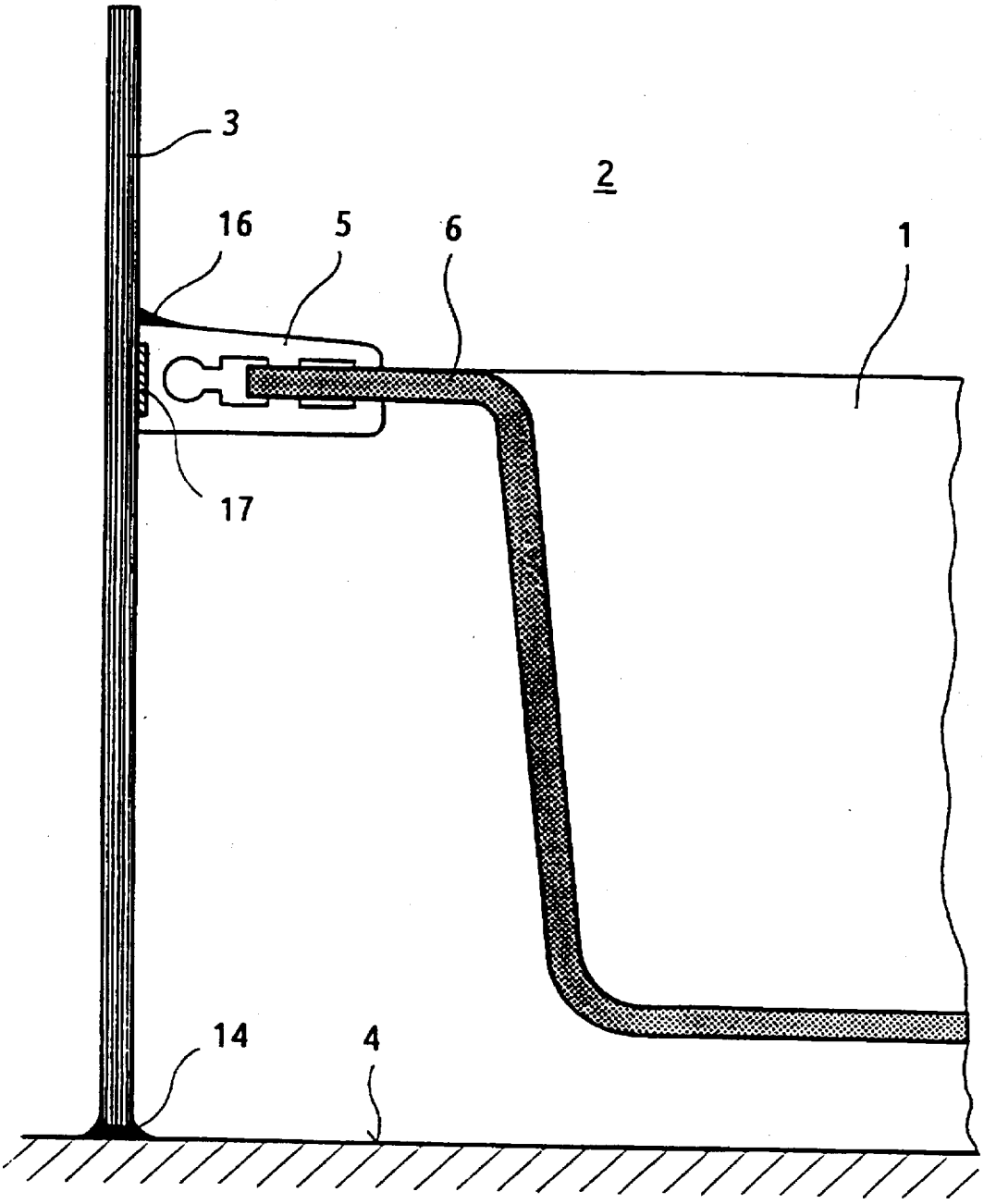
Figure 3:
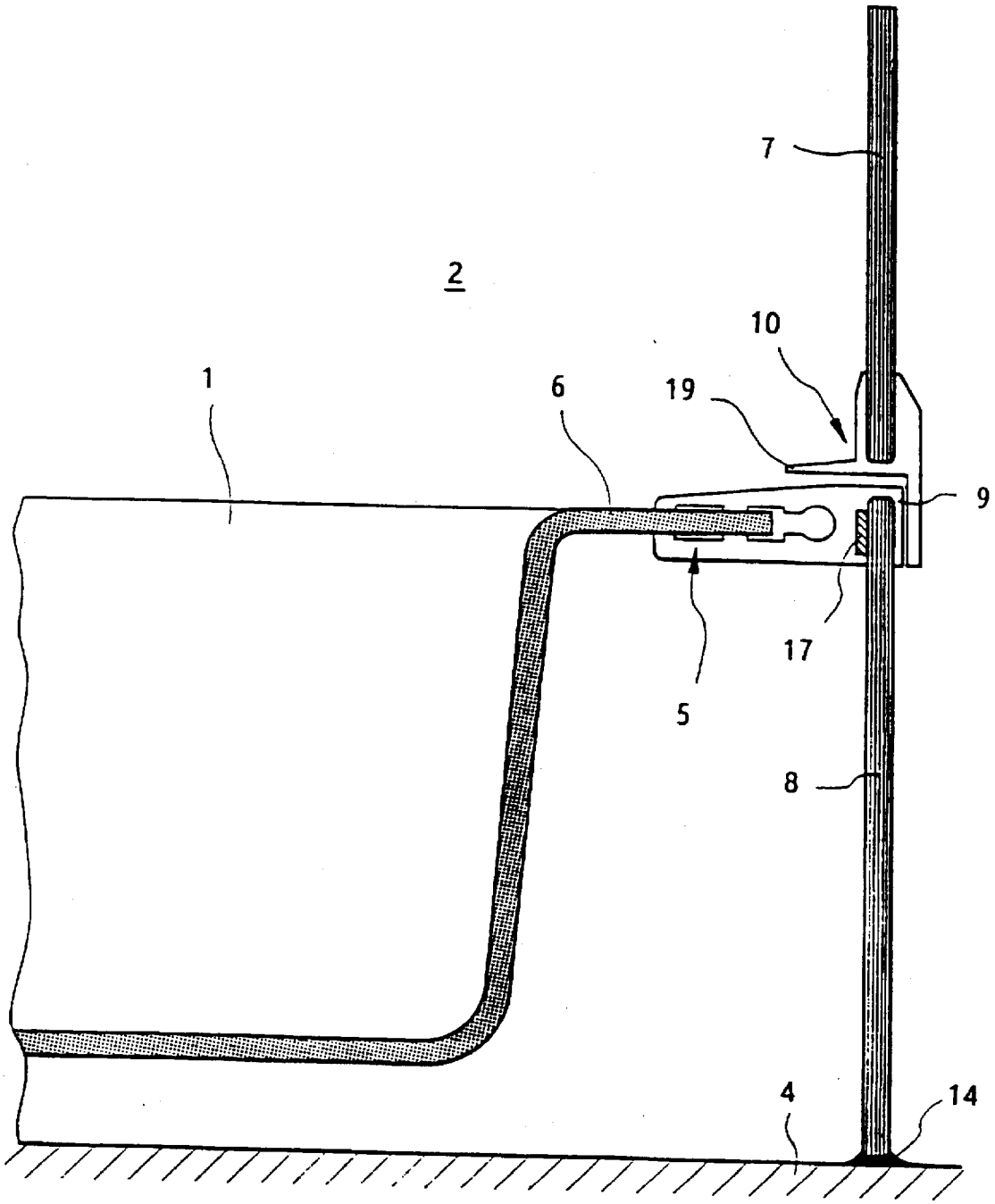
FIG. 3 is a sectional view, similar to FIG. 2, of the door area of the shower partition.
Figure 7:
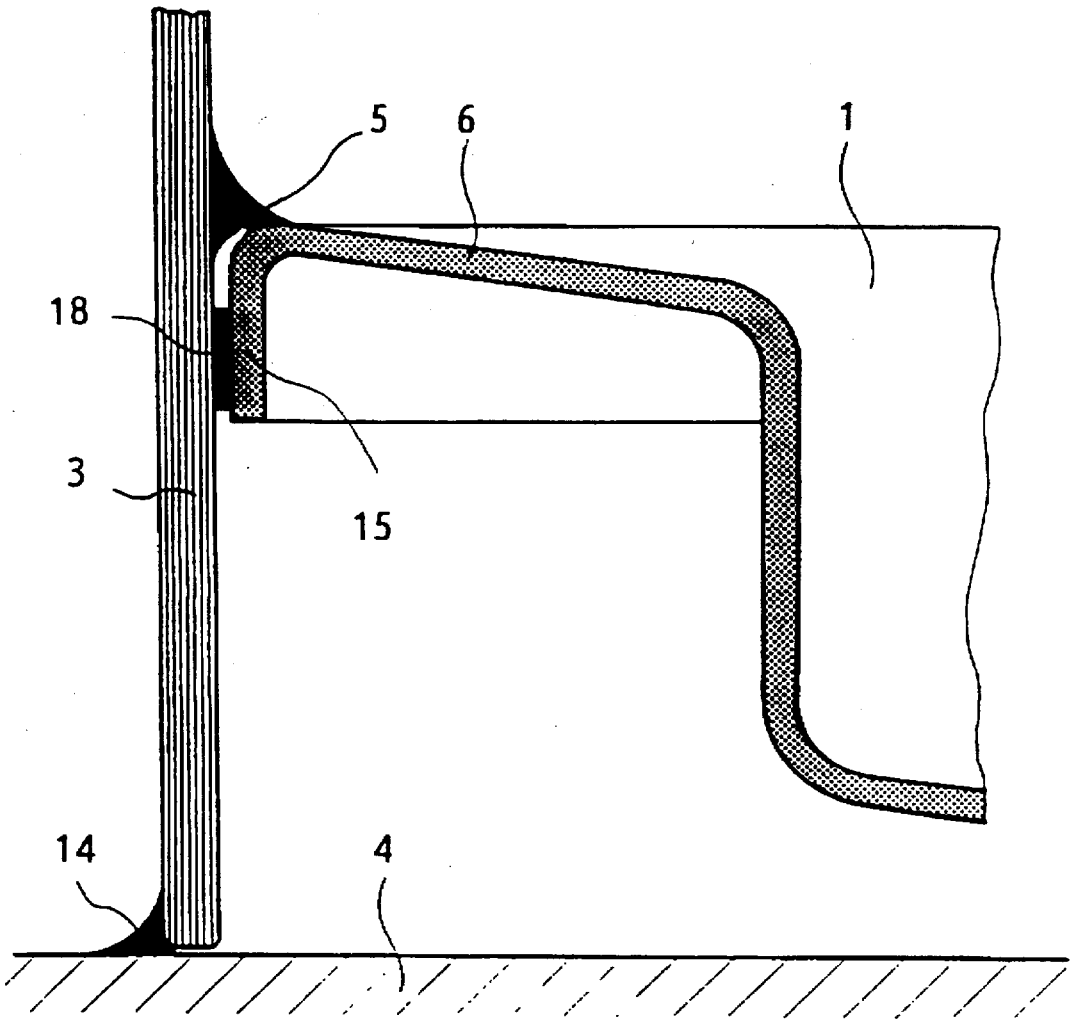
Figure 8:
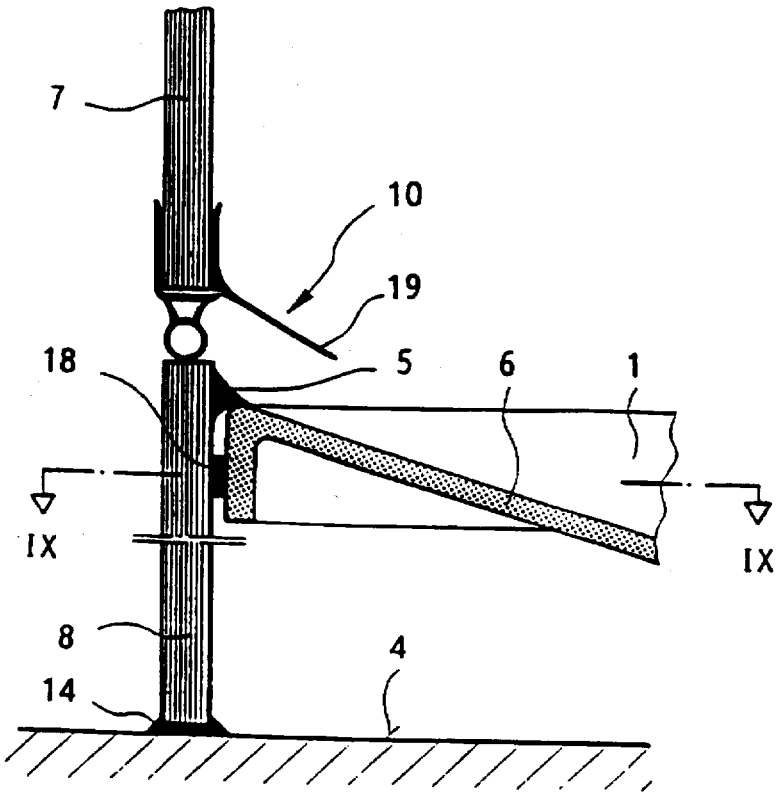
Figure 9:
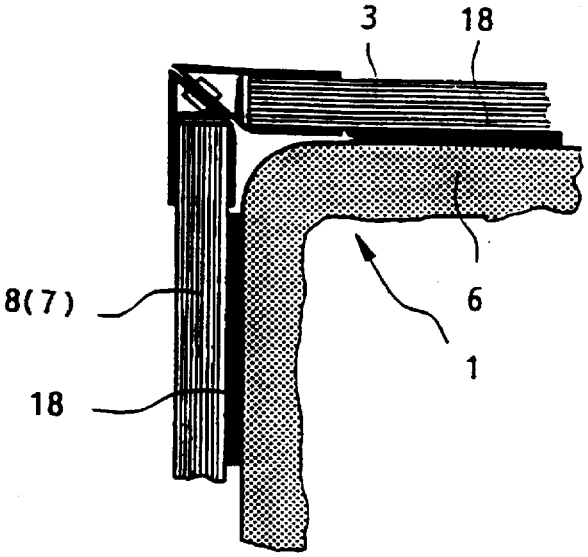
Figure 10:
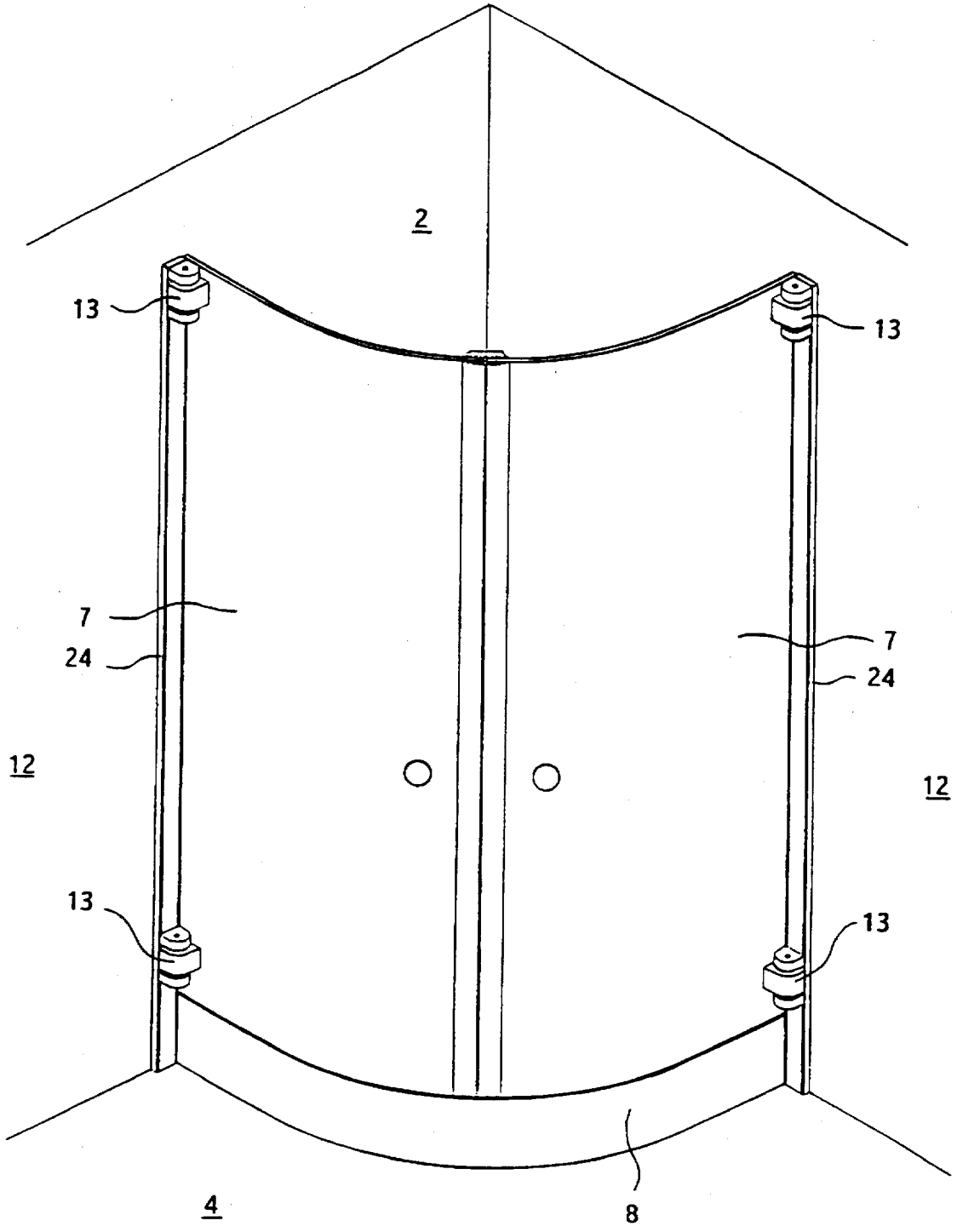
Figure 11:
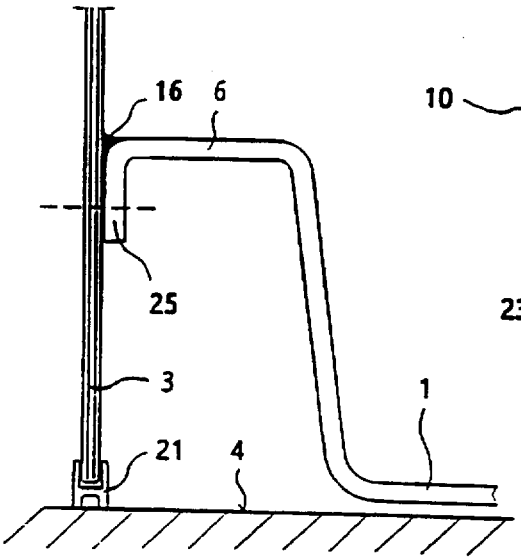
Figure 12:
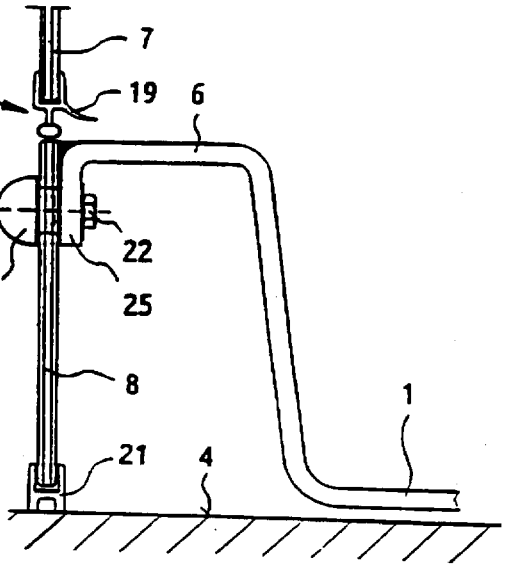
Figure 13:
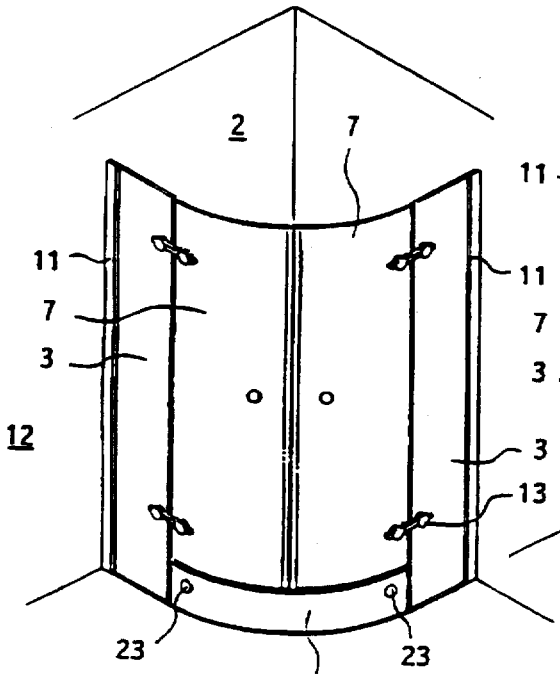
Figure 14:
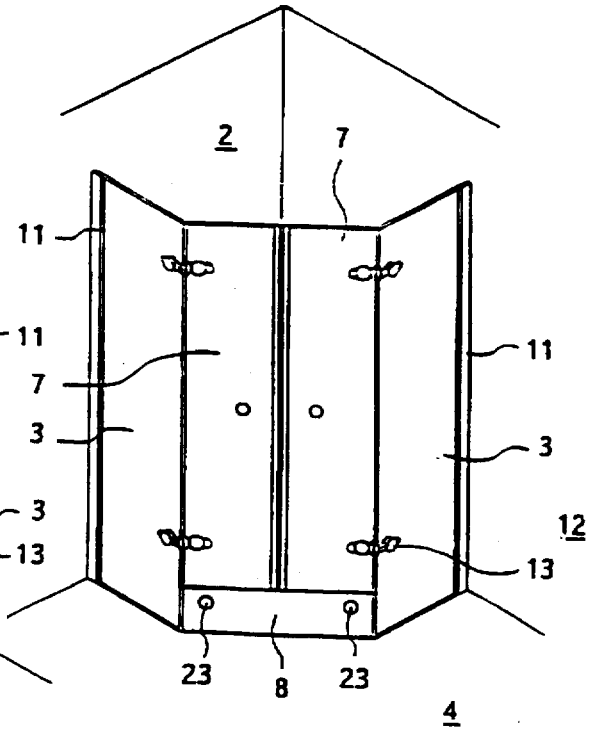

FIG. 7 partial sectional view of the tray edge and of the lower portion of the partition, similar to the illustration of FIG. 2;

FIG. 8 is a partial sectional view, similar to FIG. 3, of the lower door portion;

FIG. 9 is a top view, in section, of the transition portion between door and partition;

FIG. 10 is a perspective view of another embodiment, similar to FIG. 1;

FIG. 11 is a partial sectional view, similar to FIG. 2, of the tray and the lower portion of the partition;

FIG. 12 is a sectional view, similar to FIG. 3, of the area of the tray, the door and the shower partition;

FIG. 13 is a perspective view of another embodiment of the shower partition of the invention; and FIG. 14 is a perspective view of an additional embodiment of the invention.

Figure 6:
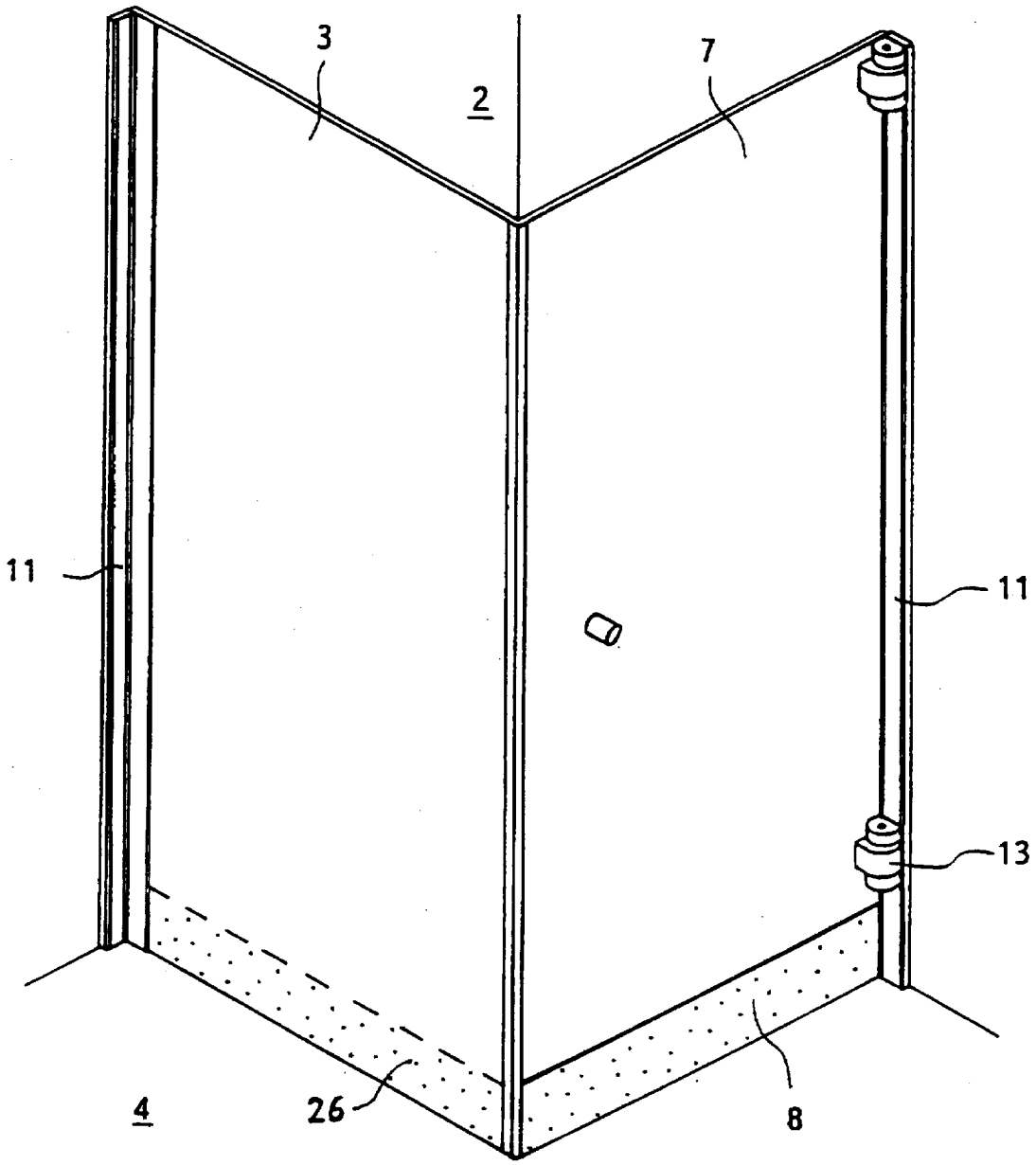
FIG. 6 is a perspective view of another embodiment of the shower partition of the invention.

FIGS. 1 and 6 are each a perspective view of an embodiment of the shower partition of the invention. The shower partition is installed on a floor 4 of a room and defines a shower compartment 2. The two other sides of the shower compartment 2 are formed by walls 12 of the room. The shower partition of the invention comprises a vertical partition unit 3 consisting of a single-pane safety glass, which is directly mounted on the floor 4 of the room. As shown in FIGS. 2 and 7, the lower edge of partition 3 is sealed with a sealing compound 14 (silicone paste or the like).

Furthermore, FIGS. 2 and 7 show part of a shower tray 1 which is provided with a tray edge 6. This edge may extend in the horizontal direction (FIG. 2), but it is also possible to design the tray edge 6 with a vertical edge 15.

Figure 4:
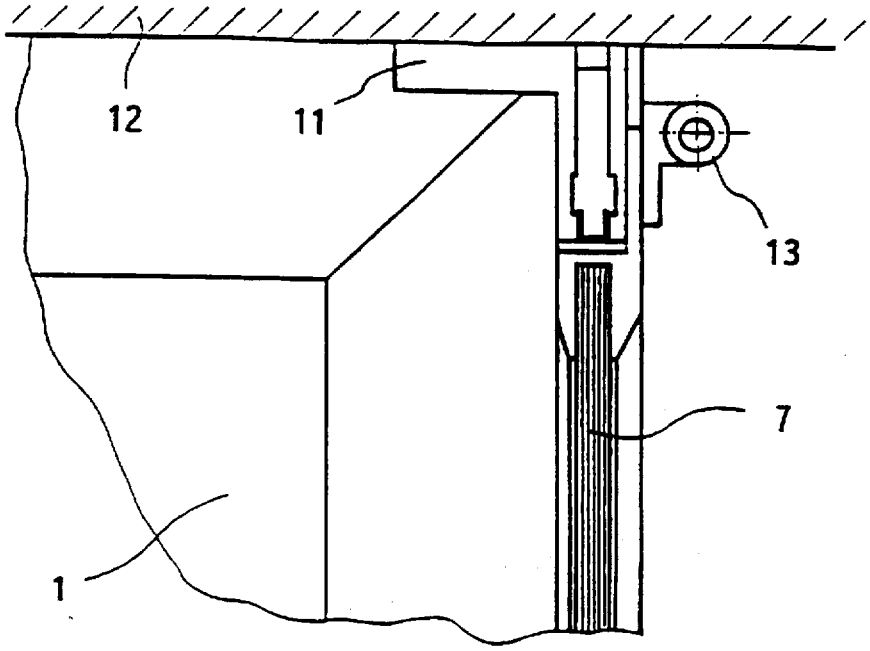
FIG. 4 is a partial top view on the hinge area of the door.
Figure 5:
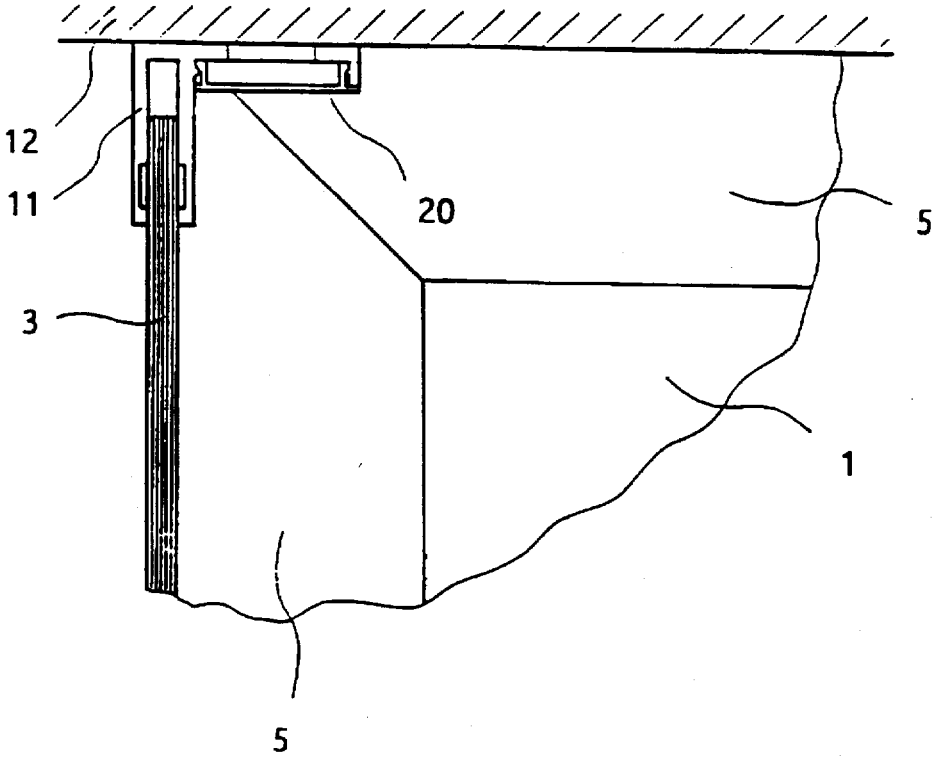
FIG. 5 is a partial top view on the wall connection portion of the partition.

In accordance with the invention, the transition between tray edge 6 and partition 3 is sealed by means of a connection profile 5. As shown in FIG. 2, the profile may be in the form of a U-shaped profile which is attached onto the tray edge 6. An additional seal may be provided by means of a silicone seam 16. In addition, the connection profile 5 can be sealed and/or glued by means of a silicone seal 17. FIGS. 4 and 5 are top views showing that the connection profile 5 surrounds the whole tray edge 6 like a frame and is provided with a 45° mitre on the edges.

In the embodiment illustrated in FIG. 7, the connection profile 5 is designed in the manner of a thick silicone seal which may be prefabricated or may be applied during installation as a paste. In addition, a silicone strip 18 is inserted between the vertical edge 15 and the partition 3. This design is also illustrated by the top view of FIG. 9. As becomes apparent from FIGS. 1 and 6, the shower partition has a door 7 which is pivotably supported by means of hinge elements 13. The door 7 ends at a distance above the floor 4, the distance corresponding to the height of the tray and the tray edge 6. A door partition 8 (see FIGS. 3 and 8, respectively) which is mounted and sealed in the same manner as partition 3 is arranged below the door. FIG. 3 shows a design variant in which the sealing profile 5 grips with a portion 9 over the upper edge of the door partition 8.

To conceal the base portion of the tray 1 or tray 1 itself in an optical manner, the door partition 8 and the lower portion of the partition 3 are provided with a decoration, a printing, or the like 26.

A sealing strip 10 which has an inwardly oriented sealing lip 19 to return splash water into the shower compartment 2 is secured to the bottom edge of door 7. In addition, the sealing strip 10, as shown in FIG. 3, can be provided with an outer stop.

The partition 3 is mounted and retained on the wall by means of a holding section 11. As shown in FIG. 5, the holding section has a U-shaped cross-section, so that partition 3 can be slid thereinto. A leg of the holding section 11 which serves fastening purposes is covered by means of a cover strip 20 to conceal the fastening screws. The door partition 8 is secured to the wall in the same manner. Furthermore, as shown in FIG. 4, the holding section 11 may serve to secure hinge elements 13. The door 7 may be provided with a frame (FIG. 1) and may also be formed without a frame, as shown in FIG. 6. FIG. 9 is a sectional top view illustrating the design of a corner portion between partition 3 and door 7 and door partition 8, respectively. As can be seen, a standard corner section as is known from the prior art can be used.

FIG. 10 shows another embodiment of the shower partition of the invention. In this embodiment, there are provided two arcuate doors 7 which are supported by means of hinge elements 13 on wall rails 24. The wall rails are, for instance, constructed in the manner of the holding section shown in FIG. 6. To cover the base portion of the shower tray, there is provided a substantially arcuate door partition 8 which is formed by analogy with the door partition described in the preceding embodiments.

Each of FIGS. 11 and 12 shows developments of the invention in which partition 3 and door partition 8, respectively, are sealed relative to the floor 4 of a building via a floor sealing profile 21 which has a substantially H-shaped cross-section.

FIG. 12 further shows a variant of the design illustrated in FIG. 3, in which a free and vertically extending edge 25 of tray 1 is additionally screwed to the door partition 8. To this end, door partition 8 comprises recesses through which screw 22 can be guided. Screw 22 may be concealed to the outside with a decorative cap 23. This possible solution is also diagrammatically shown in FIG. 11; the decorative caps 23 are also shown in FIGS. 13 and 14. The embodiments of FIGS. 13 and 14 respectively show another variant of the shower partition of the invention wherein the shower is formed as a corner shower. Walls 12 have each mounted thereon, via holding sections 11, vertical partitions 3 which, in turn, have supported thereon doors 7 by means of hinge elements 13. This effects a symmetrical structure. The two embodiments differ in the shapes of doors 7, which may either be arcuate (FIG. 13) or plane (FIG. 14). A fitting door partition 8 is mounted in both cases.

It goes without saying that an inspection hole can be provided in the lower portion of partition 3 and in door partition 8, respectively, to have access to the connections of tray 1. The inspection hole can be covered with a conventional, magnetically held flap.

The invention is not limited to the illustrated embodiments; rather many modifications and alterations are possible and obvious to one skilled in the art within the scope of the present invention.

In summary, the following should be noted:

The present invention relates to a shower partition comprising at least one vertical partition unit (3) which separates the shower compartment (2) formed by a shower tray (1) from the rest of the room in a building, characterized in that the partition (3) is adjacent to the tray edge and extends upwards from the floor (4) of the room to a predetermined height (FIG. 1).

I claim:

1. In combination with a shower compartment which includes a shower tray on the floor thereof wherein the shower tray includes an edge around a portion of its circumference, a shower partition comprising:

a primary partition adjacent the edge of the shower tray and extending upwards from the floor to a predetermined height above the shower tray, wherein the primary partition comprises a single piece, and wherein the primary partition is at least partially transparent above the edge and has a lower portion extending between the floor and the edge of the shower tray which includes a decoration thereon to conceal the shower tray below the edge.

2. The combination of claim 1, wherein the primary partition comprises a pane of safety glass.

3. The combination of claim 1 further comprising a connection profile that fixes the primary partition to the edge of the shower tray.

4. The combination of claim 3 wherein the edge of the shower tray extends in a horizontal direction and the connection profile comprises a U-shaped fastener with a closed end and an open end, and wherein the closed end of the fastener is fixed to the primary partition and the open end of fastener envelopes the edge of the shower tray.

5. The combination of claim 1 wherein the shower partition further comprises a door partition that extends from the floor to the edge of the shower tray, and a door that extends upward from above the edge of the shower tray to a predetermined height.

6. The combination of claim 5 wherein the door partition includes a decoration thereon to conceal the portion of the shower tray below the edge.

7. The combination of claim 5 further comprising a connection profile that joins the upper edge of the door partition to the edge of the shower tray, wherein the connection profile grips over the upper edge of the door partition.

8. The combination of claim 7 further comprising a sealing strip fixed to the lower edge of the door and sealable to the connection profile when the door is closed.

9. The combination of claim 5 further comprising a holding section attached to a vertical edge of the door and securable to a wall of the building.

10. The combination of claim 9 wherein the door is attached to the holding section by means of a hinge.

* * * * *